US005491987A

United States Patent [19]

Beconcini

[11] Patent Number: 5,491,987

[45] Date of Patent: Feb. 20, 1996

[54] IMPACT PROTECTION DEVICE FOR A ROD FOR POSITIONING THREAD GUIDES IN A CIRCULAR KNITTING MACHINE

[75] Inventor: Paolo Beconcini, Firenze, Italy

[73] Assignee: MATEC S.r.l., Scandicci, Italy

[21] Appl. No.: 426,762

[22] Filed: Apr. 21, 1995

[30] Foreign Application Priority Data

May 16, 1994 [IT] Italy ..... B094A0219

[51] Int. Cl.[6] ..... D04B 15/54

[52] U.S. Cl. ..... 66/130; 66/141

[58] Field of Search ..... 66/130, 131, 133, 66/136, 138, 141

[56] References Cited

U.S. PATENT DOCUMENTS

| | | | |
|---|---|---|---|
| 2,746,274 | 5/1956 | Zesch | 66/130 |
| 3,050,969 | 8/1962 | McCarthy | 66/130 |
| 3,095,719 | 7/1963 | Manger et al. | 66/133 |
| 3,241,338 | 3/1966 | Boutillette | 66/130 |

FOREIGN PATENT DOCUMENTS

| | | |
|---|---|---|
| 0073745 | 3/1983 | European Pat. Off. . |
| 0533086 | 3/1993 | European Pat. Off. . |
| 2102457 | 2/1983 | United Kingdom . |

*Primary Examiner*—John J. Calvert
*Attorney, Agent, or Firm*—Guido Modiano; Albert Josif

[57] ABSTRACT

An impact protection device for a rod for positioning thread guides in a circular knitting machine. The thread guide has an approach and spacing unit formed of a rod and crank system. The end of the rod carries the thread guide and an intermediate region of the rod has a longitudinal slot which is slidably guided on a stud that is rigidly coupled to a fixed arm. The device has a compression spring mounted on the stud which presses the rod against the arm. Elastic elements mounted on a rod articulation pivot pus the rod against the crank. The spring and elastic elements allow small movements of the rod from the plane of arrangement of the path of the rod in case of impact with, or scraping against, another rod.

2 Claims, 1 Drawing Sheet

IMPACT PROTECTION DEVICE FOR A ROD FOR POSITIONING THREAD GUIDES IN A CIRCULAR KNITTING MACHINE

BACKGROUND OF THE INVENTION

The present invention relates to a circular knitting machine and in particular to the feeding of the thread to said machine to produce tubular knitwear such as socks and stockings, and relates to an impact protection device for a rod for positioning the feed threads at the active needle holders of a double cylinder machine.

Double cylinder circular knitting machines are generally essentially constituted by two coaxial rotating cylinders, each of which has a corresponding plurality of longitudinal grooves at its outer cylindrical surface.

Respective needles are guided in the grooves and form the loop of knitting in their vertical stroke by cooperating with the sinkers.

The number of grooves of the cylinders is equal to the number of the needles which run within them with a reciprocating vertical motion and are exchanged between the two cylinders: for the production of hosiery items in general, there can be up to 400 grooves per cylinder, whereas for the production of men's socks the number of needles is generally between 84 and 280.

The needles are fed, in their reciprocating vertical motion, in fixed angular positions and at the most protruding levels of their strokes with respect to the cylinder on which they are located, by feeder stations which in each instance supply the needles with the feeding thread which must be knitted in the portion of knitting being formed, in that row of knitting and in that angular position: every time the feed is changed, the previously fed thread must be swapped with the thread that constitutes the new feed.

Each feeding thread is carried by a thread guide which picks up the thread from a reel: the various thread guides are placed either on mutually different levels and/or at mutually different radial distances so that the paths that they follow do not interfere and so that a thread guide can carry its thread to knit without preventing another thread guide from removing its thread from the knitting.

In thread guide actuation devices, which are often of the rod-and-crank type, the end of the thread guide usually follows a specific path, usually a curved one, lying on a plane and is always equal so as to take it from an inactive position A to a position B in which the thread is placed next to the cylinder and vice versa.

The thread guides, together with the respective rods with which they are associated, are relatively bulky and very close to each other; accordingly, it often happens that as a thread guide approaches the cylinders it strikes or scrapes against a thread guide that has not yet moved away completely: this can lead to malfunctioning, jamming, or breakage of mechanical components or of the knitting threads.

SUMMARY OF THE INVENTION

The technical aim of the present invention is to obviate the above mentioned drawbacks of conventional devices, that is to say, to provide an impact protection device for a rod for the positioning of thread guides in a circular knitting machine which avoids damaging impacts and scraping among the various components of the thread guides as they move towards or away from the cylinders.

Within the scope of this technical aim, an object of the present invention is to achieve the above aim by means of a structure that is simple, relatively easy to execute in practice, safe in use, effective in operation, as well as relatively low in cost.

This aim and this object are both achieved by the present impact protection device for a rod for positioning thread guides in a circular knitting machine of the type comprising a thread guide approach and spacing unit constituted by a rod-and-crank system wherein the end of the rod carries the thread guide and wherein an intermediate region of the rod is crossed by a longitudinal slot slideably guided with respect to a stud that is rigidly coupled to a fixed arm; said device being characterized in that a compression spring is mounted on said stud and is adapted to press said rod against said arm, and in that elastic elements adapted to push the rod against the crank are mounted on the rod articulation pivot, said spring and said elastic elements being adapted to allow small movements of the rod from the plane of arrangement of its path in case of impact with, or scraping against, another rod.

BRIEF DESCRIPTION OF THE DRAWINGS

Further characteristics and advantages will become apparent from the detailed description of a preferred but not exclusive embodiment of an impact protection device for a rod for positioning thread guides in a circular knitting machine according to the invention, illustrated only by way of non-limitative example in the accompanying drawings, wherein.

DESCRIPTION OF THE PREFERRED EMBODIMENTS

Figure 1:
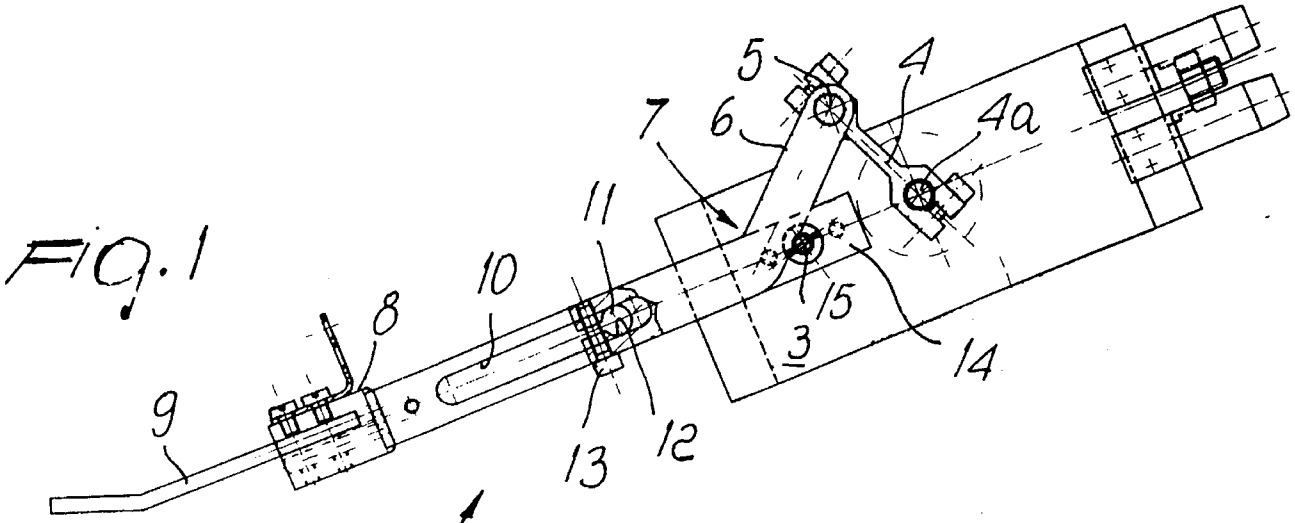
FIG. 1 is a partially sectioned top view of an impact protection device for a rod for positioning thread guides in a circular knitting machine.
Figure 2:
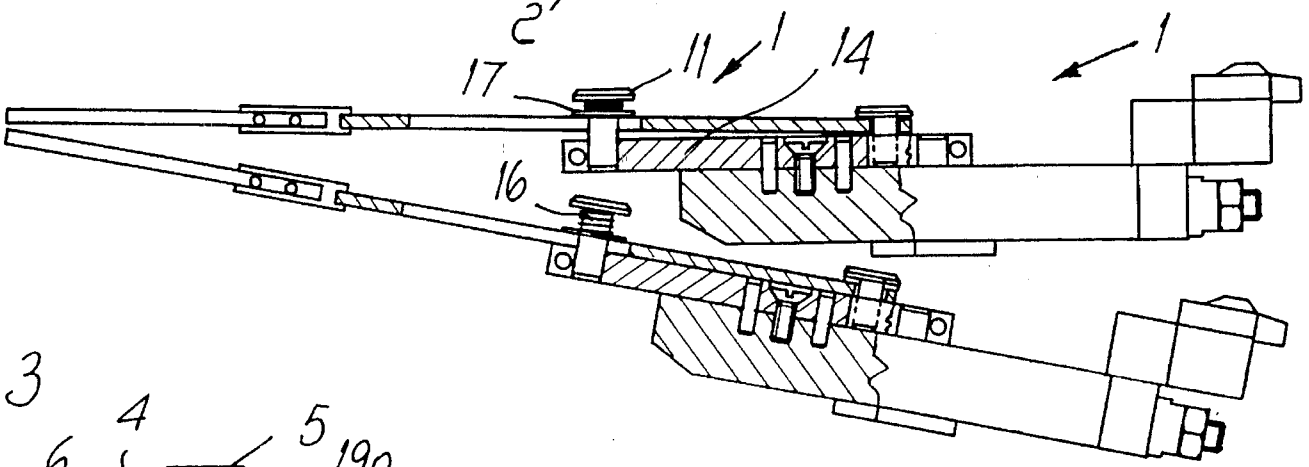
FIG. 2 is a sectional front view of said device.
Figure 3:
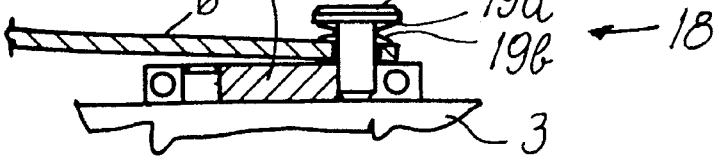
FIG. 3 is an enlarged-scale sectional front view of a detail of FIG. 2.

With particular reference to the above figures, the reference numeral 1 generally designates an impact protection device for a rod for positioning thread guides in a circular knitting machine according to the invention.

The device 1 is mounted on a conventional thread guide approach and spacing unit 2 constituted by a plate-like support 3 on which a pivot **4*a* is rotatably mounted; one end of a crank 4 is fixed to said pivot 4*a*, and the crank 4 has, at the other end, a pivot 5 to which one end of a rod 6 is articulated: the rod 6 forms an obtuse angle 7 and has, at its other end, clamps 8 for securing a thread guide 9: in its intermediate region, the rod 6 has a longitudinal slot 10 slideably guided with respect to a fixed slider constituted by a slideable stud 11 in the slot 10 and is fixed to the end of an arm 14 by means of a coupling formed by a split hole 12 and a lock nut 13; the arm 14 can be rigidly coupled by tightening the screw 15 on the support 3 in a position whose angle is adjustable: by varying the length of the arm 14 and its angular position with respect to the support 3 it is possible to vary the path followed by the thread guide when the crank 4** is actuated.

The device 1 substantially consists of a helical compression spring 16 mounted on the stud 11, and presses a washer 17 against the surface of the rod 6, and is adapted to press the rod against the arm 14: elastic elements 18 are mounted on the articulation pivot 5 of the rod-and are constituted by two cup-shaped springs 19*a*, 19*b* adapted to press the end of the rod against the crank: the spring 16 and the springs 19*a,b* are adapted to allow the rod to move slightly with respect to the normal plane of arrangement if it collides or scrapes against another rod.

It has thus been observed that the invention achieves the intended aim and object.

The invention thus conceived is susceptible of numerous modifications and variations, all of which are within the scope of the inventive concept.

All the details may furthermore be replaced with other technically equivalent ones.

In practice, the materials used, as well as the shapes and dimensions, may be any according to the requirements without thereby abandoning the scope of the protection of the following claims.

What is claimed is:

1. Impact protection device for a rod for positioning thread guides in a circular knitting machine of a type comprising a thread guide approach and spacing unit constituted by a rod-and-crank system wherein an end of the rod carries the thread guide and wherein an intermediate region of the rod is crossed by a longitudinal slot slideably guided with respect to a stud that is rigidly coupled to a fixed arm; and wherein a compression spring is mounted on said stud for pressing said rod against said arm, elastic elements for pushing the rod against the crank being mounted on a rod articulation pivot, said spring and said elastic elements allow small movements of the rod from the plane of arrangement of a path of the rod in case of impact with, or scraping against, another rod.

2. Device according to claim 1, wherein said elastic elements comprise two cup springs.

* * * * *